US009169836B2

(12) United States Patent
Yang

(10) Patent No.: US 9,169,836 B2
(45) Date of Patent: Oct. 27, 2015

(54) STRUCTURE OF SIMPLIFIED INFLATION VALVE

(71) Applicant: UNIVERSAL TRIM SUPPLY CO., LTD., New Taipei (TW)

(72) Inventor: Shih-Sheng Yang, New Taipei (TW)

(73) Assignee: Universal Trim Supply Co., Ltd., New Taipei (TW)

( * ) Notice: Subject to any disclaimer, the term of this patent is extended or adjusted under 35 U.S.C. 154(b) by 317 days.

(21) Appl. No.: 13/831,325

(22) Filed: Mar. 14, 2013

(65) Prior Publication Data

US 2014/0241922 A1 Aug. 28, 2014

(30) Foreign Application Priority Data

Feb. 22, 2013 (TW) ..... 102106180 A

(51) Int. Cl.

| | |
|---|---|
| ***F04B 43/00*** | (2006.01) |
| ***F04B 33/00*** | (2006.01) |
| ***F04B 45/02*** | (2006.01) |
| ***F04B 45/04*** | (2006.01) |

(52) U.S. Cl.

CPC ..... *F04B 43/00* (2013.01); *F04B 33/00* (2013.01); *F04B 45/02* (2013.01); *F04B 45/04* (2013.01)

(58) Field of Classification Search

CPC ..... F04B 43/00; F04B 45/02; F04B 45/045; F04B 33/00

USPC ..... 417/472, 480; 251/331, 904

See application file for complete search history.

(56) References Cited

U.S. PATENT DOCUMENTS

| | | | | |
|---|---|---|---|---|
| 2,604,297 | A * | 7/1952 | Winstead | 137/223 |
| 3,068,494 | A * | 12/1962 | Pinkwater | 5/708 |
| 2011/0293454 | A1 * | 12/2011 | Yang | 417/480 |

* cited by examiner

*Primary Examiner* — Charles Freay
*Assistant Examiner* — Kenneth J Hansen
(74) *Attorney, Agent, or Firm* — Leong C. Lei

(57) ABSTRACT

A simplified inflation valve includes a base forming centrally a bore. The bore has a bottom to which a PU membrane is attached. The membrane includes at least one aperture in a location outboard the bore. An outer circumference of the membrane is fixed to the base through ultrasonic technique or die pressing. A squeezer is mounted on the base and has elasticity for elastically resuming shape after being pressed and has an interior space forming an air chamber. The air chamber has a top forming at least one through hole. The squeezer has a bottom including an outer circumferential portion forming a sealing rim, which is fixed, through ultrasonic technique or die pressing, to the base so as to form an inflation valve. The inflation valve can be connected to an air bladder, whereby through pressing the inflation valve, the air bladder can be inflated.

6 Claims, 4 Drawing Sheets

STRUCTURE OF SIMPLIFIED INFLATION VALVE

(a) TECHNICAL FIELD OF THE INVENTION

The present invention generally relates to an inflation valve for lining air pocket that provides a cushioning protection effect for applications in sports shoes, athletic shoes, leisure shoes, helmets, or similar products that need an inflated cushioning lining structure.

(b) DESCRIPTION OF THE PRIOR ART

Besides an important issue of good looking, the design of shoe must also take functionality into consideration. For example, air cushioning pad can be mounted in shoe to provide cushioning of impact so that the foot of a user can be best protected in walking, running, and jumping when doing exercise. In addition, a lining of a helmet also needs a pad for cushioning.

A conventional shoe having inflatable air bladder, such as U.S. Pat. No. 6,189,172, provides a pump and a relief valve of which the components include an air bladder pump having an inlet and an outlet that functions to conduct air into the air bladder; a relief valve, which has an entrance opening that is in fluid communication with the air bladder and an exit opening. The relief valve comprises: a valve body that is made of a non-soft material and having an internal hole extending from an inlet opening to an outlet opening; a raised rim that has an upper end extending inward, the raised rim comprising a bottom surface, a top surface, and an internal hole extending from the bottom surface to the top surface, the bottom surface functioning as an air valve seat; a plunger, which extends through the internal hole of the valve body, the plunger having an upper section that has a reduced diameter to allow of extension thereof through the internal hole of the raised rim that has an upper end extending inward, the plunger also comprising a lower section having an expanded diameter to prevent extension thereof through the internal hole of the raised rim that has an upper end extending inward, the lower section of the plunger having a top surface that corresponds to a bottom surface of the raised rim that has an upper end extending inward and a bottom surface; and a ring, which is made of a soft material and is arranged between the lower section of the plunger and the raised rim that has an upper end extending inward.

However, for the previously described inflatable air bladder of shoe, the pump and the relief valve are connected to the air bladder by a conduction tube. To use, manual operation of the pump must be exercise after the shoe is put on in order to charge air into and inflate the air bladder inside the shoe. The pump and the relief valve are exposed outside the shoe, making it not possible to have a beautiful appearance. To overcome such a problem, the present invention aims to provide a device that can be mounted in a sports shoe in such a way that the shoe can be put on in the same way as a regular shoe and inflation of the air bladder can be achieved by the walking action of the user when the shoe is put on the foot of the user so that the interior of the shoe is provide a means for contacting the sole in a soft, shake-proof, and resilient manner, making the shoe more complying with the foot and providing significant comfortableness in heavy exercise.

SUMMARY OF THE INVENTION

The primary object of the present invention is to provide a simplified inflation valve, which is operable to fill air into an air bladder that is arranged in a shoe as lining in order to provide excellent cushioning and protection for foot.

Another object of the present invention is to provide a simplified inflation valve, which comprises constituent components that are simple in structure so as to reduce the manufacturing cost and improve competition power of product in market.

To achieve the above objects, the present invention provides a simplified inflation valve, which comprises: a base, a PU membrane, and a squeezer. The base has a top surface on which a tubular seat is formed centrally. The tubular seat forms therein a bore extending therethrough. The PU membrane comprises at least one aperture formed in an outer circumferential portion of the bore of the base. The membrane has an outer circumference that is fixed to the base through ultrasonic technique or die pressing so as to form an arrangement of one-way air valve. The squeezer has an interior space forming an air chamber. The air chamber has a top forming at least one through hole. The squeezer has a bottom comprising an outer circumferential portion forming a sealing rim, which is fixed, through ultrasonic technique or die pressing, to the base so as to form an inflation valve that has an air chamber. To use, the inflation valve is coupled to one side of an air bladder to form a lining air bladder, which can be mounted in a shoe. As such, treading actions of a user walking can be applied to directly press the inflation valve for filling air into the air bladder so as to provide comfortable and complete enclosure around the foot to ensure effects of safety and protection.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 2:
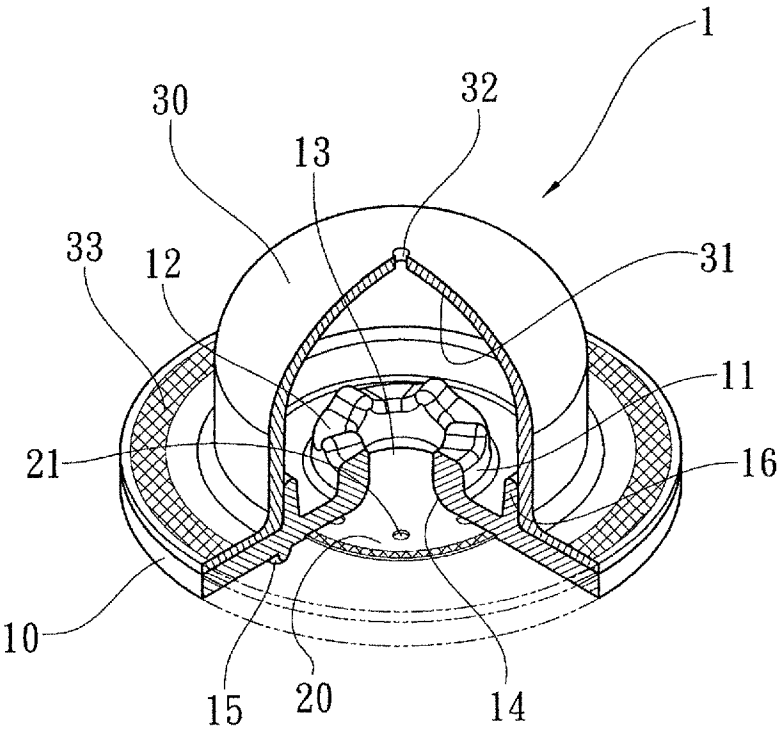
FIG. 2 is a perspective view, partially broken, showing the inflation valve of the present invention in an assembled form.
Figure 1:
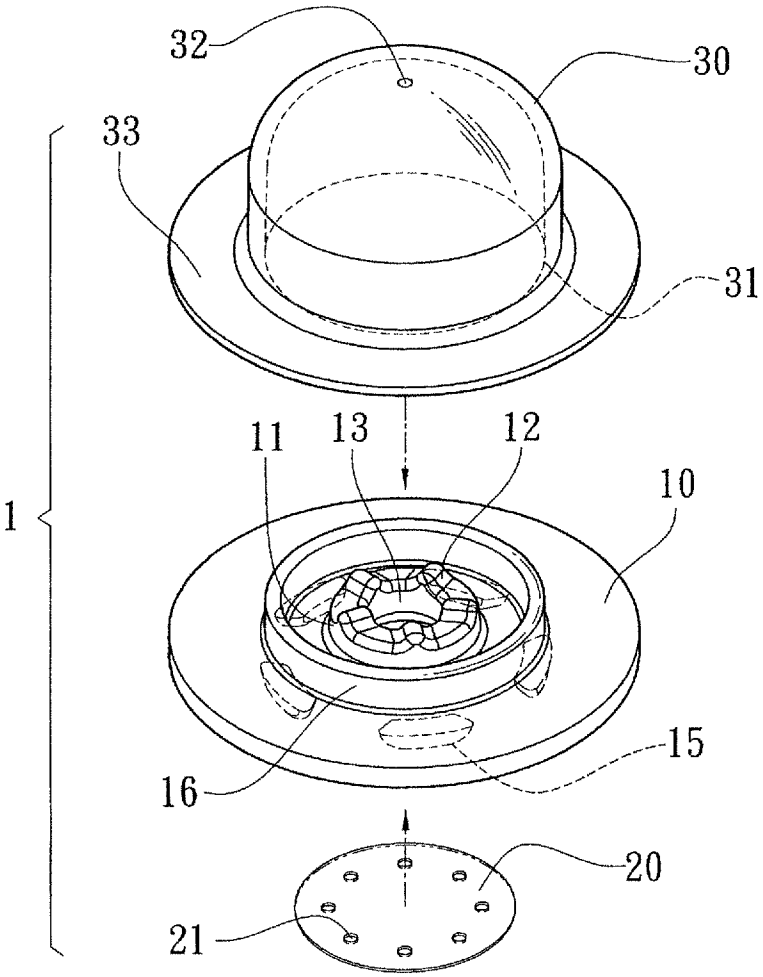
FIG. 1 is an exploded view of an inflation valve according to the present invention.

Referring to FIGS. 1 and 2, the present invention provides a simplified inflation valve 1, of which the structure comprises a base 10, a PU (Polyurethane) membrane 20, and a squeezer 30. The base 10 is preferably made of a rigid plastic material, such as TPU (Thermoplastic Urethane), and is of a form of disk and comprises a tubular seat 11 formed at a central portion of the top thereof. The tubular seat 11 has a top face that is alternately recessed and raised to provide a corrugation face 12. The tubular seat 11 forms therein a bore 13 extending therethrough. Preferably, on the bottom of the bore 13, a chamfer 14 that is rounded is formed and a plurality of projecting ribs 15 is provided on an outer circumferential portion thereof. Further, the top of the base 10 is provided with a raised ring 16 located outside an outer circumference of the tubular seat 11.

The PU membrane 20 is attached to the bottom of the bore 13 of the base 10 and comprises at least one aperture that is set at a location exceeding a diameter of the bore 13. In the preferred embodiment shown in the drawings, a plurality of apertures 21 is provided. The PU membrane 20 has an outer circumference that is fixed to the base 10 through ultrasonic techniques or die pressing, whereby the apertures 21 are at locations that are outboard the bore 13 for forming a one-way valve.

The squeezer 30 is mounted on the base 10 and is made of an elastic material and comprises an interior space that forms an air chamber 31. The air chamber 31 has a top in which a through hole 32 is formed. The squeezer has a bottom that comprises an outer circumferential portion forming a sealing rim 33. The sealing rim 33 is fixed to the base 10 also through ultrasonic techniques or die pressing so as to form an inflation valve 1 having an air chamber. In alternative embodiments, the squeezer 30 may comprises a one-way valve (not shown) mounted the through hole 32 in the top of the air chamber. The process of ultrasonic or die pressing used to fix components together can be replaced by other technical solutions, such as bonding with adhesives.

Figure 3:
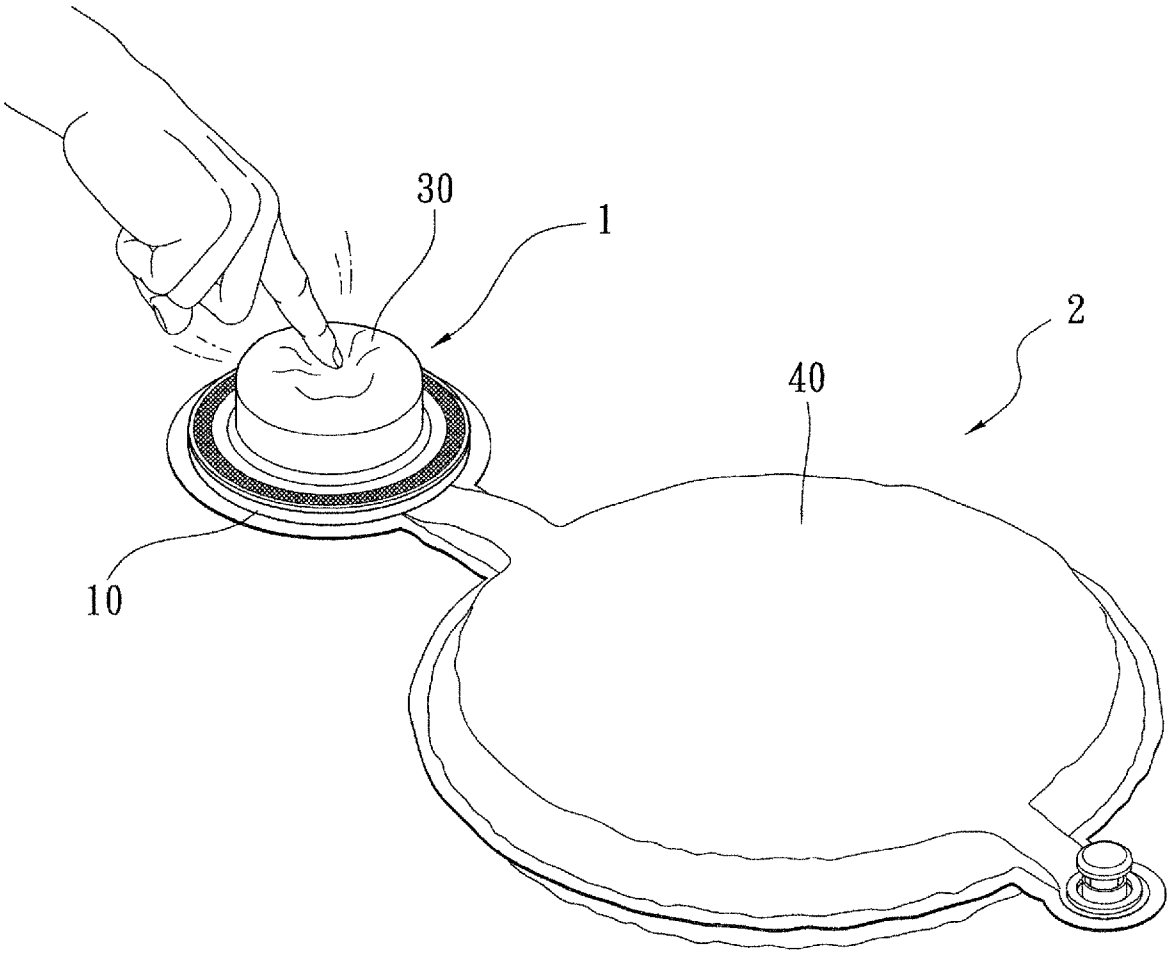
FIG. 3 is a perspective view showing the present invention is coupled with an air bladder to form a lining air bladder.
Figure 4A:
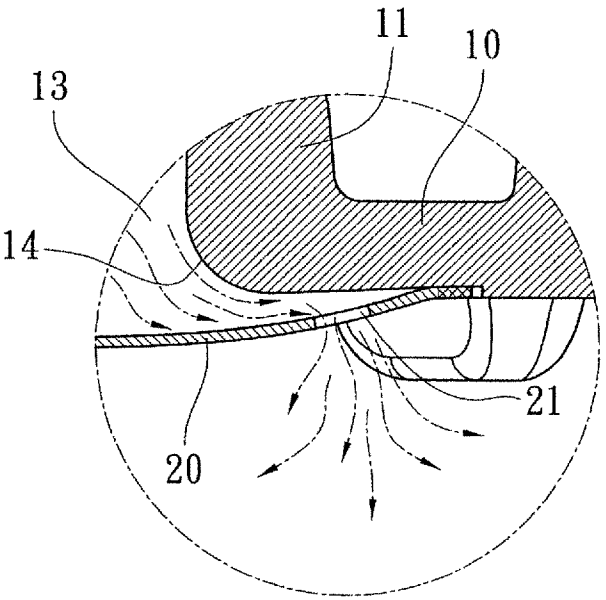
FIG. 4A is an enlarged view of a portion of the inflation valve of the present invention in the operation of inflation.
Figure 4:
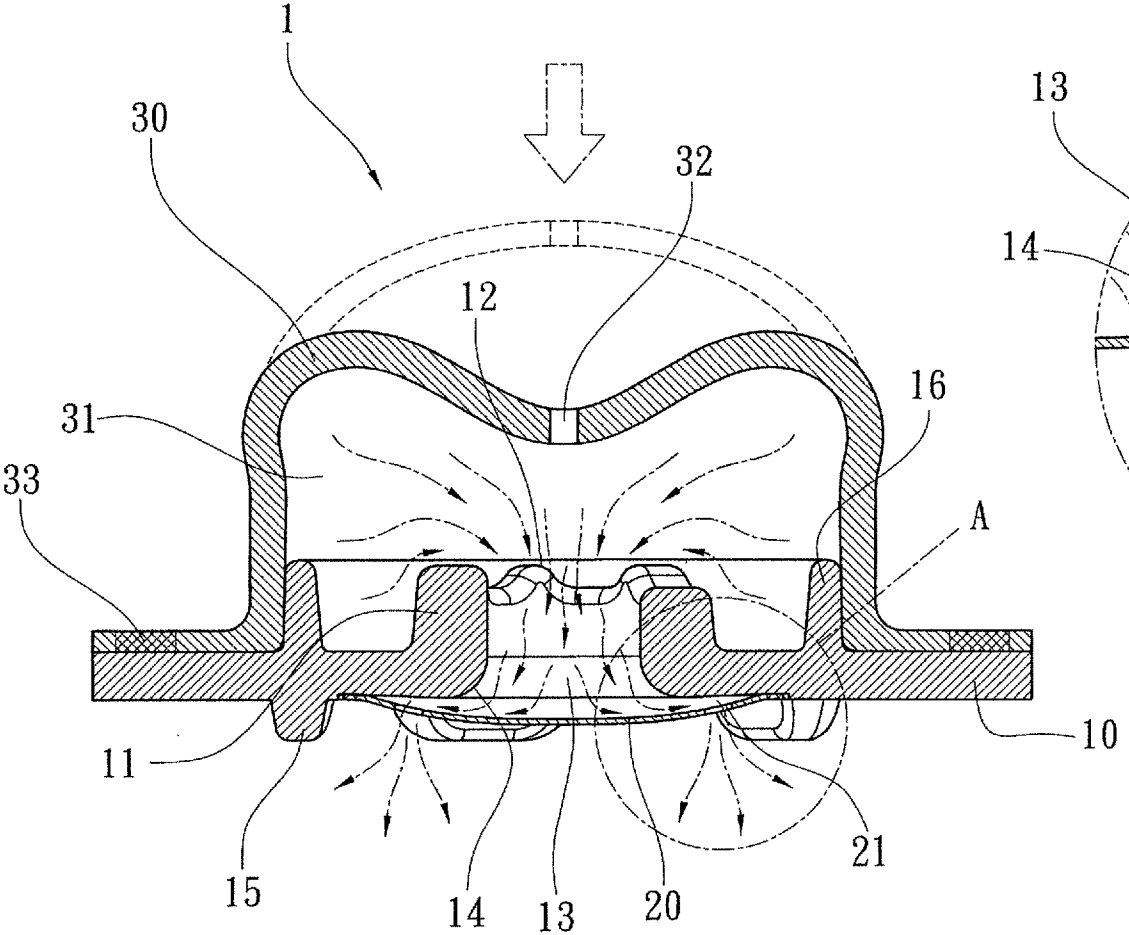
FIG. 4 is a cross-sectional view illustrating an operation of the inflation valve of the present invention for inflation.
Figures 5, 5A:
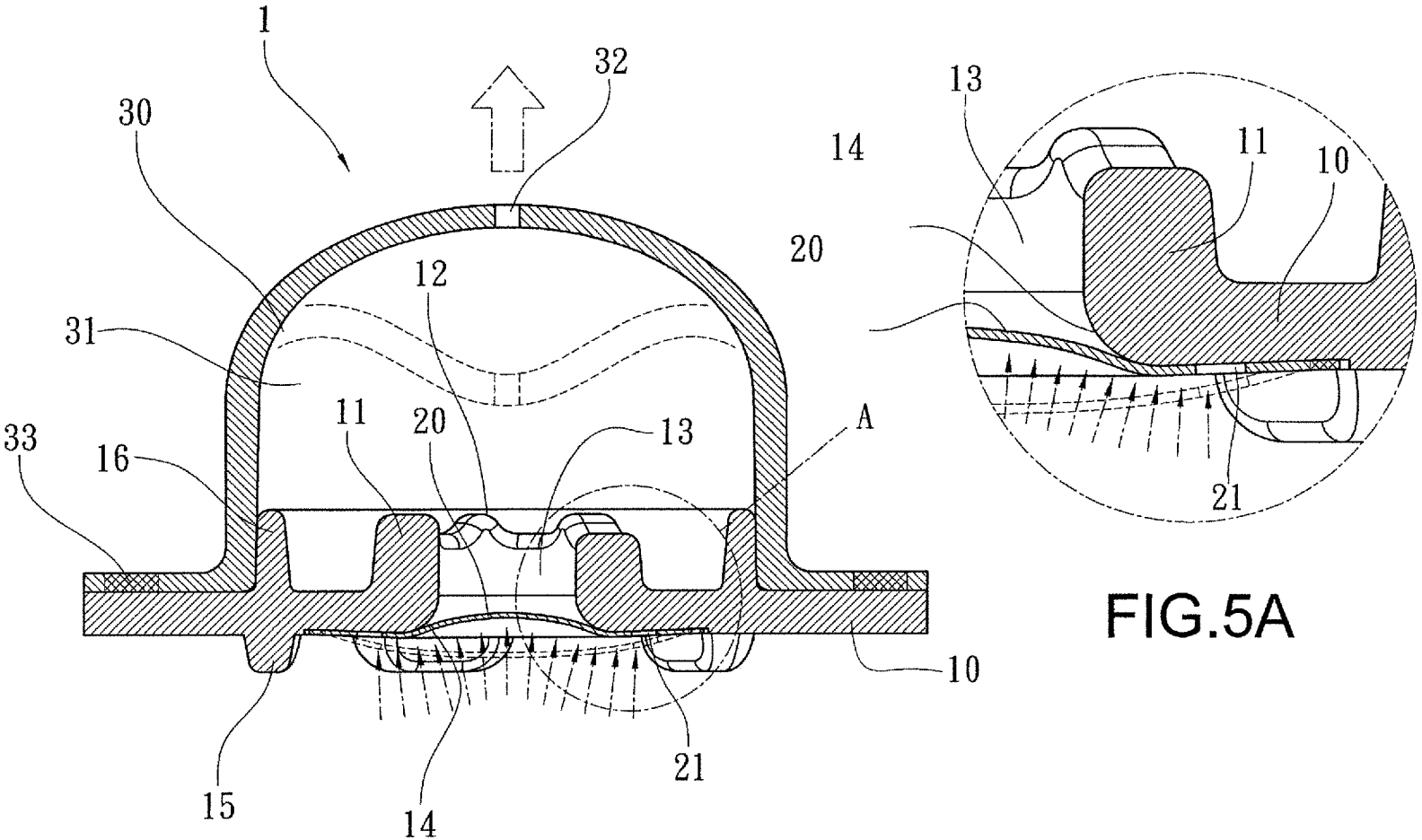
FIG. 5 is a cross-sectional view illustrating a condition of the inflation valve that prevents reversed flow.
FIG. 5A is an enlarged view of a portion of the inflation valve of the present invention in the condition of preventing reversed flow.

Referring to FIGS. 3-5, in the embodiment illustrated in the drawings, the simplified inflation valve 1 is connected to a side of an air bladder 40 to constitute a lining air bladder 2 (as shown in FIG. 3). When a force is applied to the squeezer 30 of the inflation valve 1, air contained in the air chamber 31 of the squeezer 30 is compressed and discharged through the bore 13 of the base 10. The PU membrane 20 on the bottom of the bore 13 is pressurized by the discharged air to form tiny gap to allow air to flow through the apertures of the PU membrane 20 into the air bladder 40 (as shown in FIGS. 4 and 4A). When the force is removed from the squeezer 30, the squeezer 30 generates a spring-back restoration force, whereby air is drawn through the through hole 32 in the top into and fills up the air chamber 31. Under this condition, the PU membrane 20 on the bottom of the bore 13 is acted upon by the negative pressure of the air chamber 31 and the pressure of the air contained in the air bladder 40 to position flat on the bore 13. Due the membrane is made of a material that is at least slightly flexible, the PU membrane 20 forms a concave surface in the bore 13 (as shown in FIGS. 5 and 5A), thereby tightly attached to the circumferential portion of the bore 31 to ensue an effect of preventing reversed flow of air and thus providing a one-way valve. In this way, repeated squeezing achieves filling air into the air bladder 40.

As such, when the lining air bladder 2 is mounted in a shoe, a user may successively pressing the inflation valve 1 due to treading action caused by walking so that air is filled into and inflates the air bladder 40 so as to provide comfortable enclosure and excellent protection.

In other embodiments that are not shown in the drawings, the present invention can be used as a lining element of a helmet, whereby when the helmet is put one, inflation can be carried out to provide an enclosure through pressing action. The air can be relieved after the helmet is taken off.

In summary, the present invention can definitely achieve the desired objects and provide a simplified inflation valve of lining air bladder that can protect foot in a comfortable and safe manner and shows advantages in reducing the manufacturing cost.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A simplified inflation valve, comprising a base, a polyurethane membrane, and a squeezer, the improvements comprising:

the base being a disk-like member having a top surface on which a tubular seat is formed centrally, the tubular seat forming therein a bore extending therethrough to a bottom surface of the base;

the polyurethane membrane being arranged at a bottom of the bore and comprising at least one aperture formed in the membrane at a location corresponding to an outer circumferential portion of the bore of the base, the membrane having an outer circumference that is fixed to the bottom surface of the base through ultrasonic technique or die pressing so as to cover the bore, wherein the aperture is set at a location engageable with and closable by the bottom surface of the base in a closed position where air is blocked from passing through the aperture and wherein the polyurethane membrane is deflectable to disengage from the bottom surface of the base to open the aperture in an open position where air is allowed to pass through the aperture; and the squeezer being mounted on the base and having elasticity for elastically resuming shape after being pressed and having an interior space forming an air chamber, the air chamber having a top forming at least one through hole, the squeezer having a bottom comprising an outer circumferential portion forming a sealing rim, which is fixed, through ultrasonic technique or die pressing, to the base so as to form an inflation valve.

2. The simplified inflation valve according to claim 1, wherein the bottom of the bore of the base comprises a chamfer that is rounded.

3. The simplified inflation valve according to claim 1, wherein the tubular seat on the central portion of the base has a top face that is alternately recessed and raised to form a corrugation face.

4. The simplified inflation valve according to claim 1, wherein the base has a top having an outer circumferential portion on which a raised ring is formed.

5. The simplified inflation valve according to claim 1, wherein the base comprises an outer circumferential portion outboard the polyurethane membrane and comprises a plurality of projecting ribs formed thereon.

6. The simplified inflation valve according to claim 1, wherein the through hole in the top of the air chamber of the squeezer comprises a one-way valve mounted thereto.

* * * * *